US005388278A

United States Patent [19]

Taniuchi

[11] Patent Number: 5,388,278

[45] Date of Patent: Feb. 14, 1995

[54] AIR INTAKE DEVICE IN HELMET

[75] Inventor: Fujio Taniuchi, Tokyo, Japan

[73] Assignee: Shoei Kako Kabushiki Kaisha, Tokyo, Japan

[21] Appl. No.: 177,955

[22] Filed: Jan. 6, 1994

[30] Foreign Application Priority Data

Aug. 3, 1993 [JP] Japan ..... 5-042605[U]

[51] Int. Cl.[6] ..... A42B 1/08

[52] U.S. Cl. ..... 2/422; 2/424; 2/171.3

[58] Field of Search ..... 2/410, 411, 422, 424, 2/425, 436, 437, 9, 171.3, 184.5

[56] References Cited

U.S. PATENT DOCUMENTS 5,170,511 12/1992 Kamata ..... 2/424

FOREIGN PATENT DOCUMENTS 571065 11/1993 European Pat. Off. ..... 2/411

*Primary Examiner*—Clifford D. Crowder
*Assistant Examiner*—Michael A. Neas
*Attorney, Agent, or Firm*—Armstrong, Westerman, Hattori, McLeland & Naughton

[57] ABSTRACT

In an air intake device in a helmet, a housing is molded as one piece from a synthetic resin material and as an upper wall, a lower wall, a left end wall and a right end wall. First and second recesses are defined in the back surface of the upper wall and in the front surface of the lower wall, respectively, so as to communicate with each other to define a shutter chamber. Wind guide sleeves are formed on the lower wall which are opened and closed by a shutter plate which is vertically accommodated in the shutter chamber. The housing of shutter as an essential part of the air intake device in the cap body is formed of a single piece of a synthetic resin, thereby providing a simplified structure.

2 Claims, 7 Drawing Sheets

AIR INTAKE DEVICE IN HELMET

BACKGROUND OF THE INVENTION

1. Field of the Invention

The field of the present invention is air intake devices in helmets for use mainly by an occupant on a motorcycle or a racing car, and particularly, improvements in air intake devices in helmets, of a type having a shutter means mounted to a front surface of a cap body, the shutter means including a housing having a wind guide sleeve for permitting an open air to be introduced into an air duct in the cap body, and a shutter plate vertically movably accommodated in the housing for opening and closing the air duct.

2. Description of the Prior Art

Such air intake devices in helmets are already known, as disclosed, for example, in Japanese Utility Model Publication No.89517/92.

The shutter means of the prior art air intake device has its housing constructed of a base plate and a cover coupled to a front surface of the base plate, and a shutter chamber for accommodating the shutter plate is defined between the base plate and the cover. A housing constructed from two parts in this manner requires many steps such as molding of the two parts and coupling of them, resulting in an inevitable increase in cost.

SUMMARY OF THE INVENTION

Accordingly, it is an object of the present invention to provide an inexpensive air intake device of the type described above, wherein a housing of shutter means can be formed of a single piece.

To achieve the above object, according to the present invention, there is provided an air intake device in a helmet having a cap body, the air intake device comprising a shutter means mounted to a front surface of the cap body, the shutter means including a housing having a wind guide sleeve for permitting an open air to be introduced into an air duct in the cap body, and a shutter plate vertically movably accommodated in the housing for opening and closing the air duct, wherein the housing is molded as one piece from a synthetic resin material and is comprised of an upper wall having a first recess provided in a back surface thereof, a lower wall having, in a front surface thereof, a second recess which defines a shutter chamber for accommodating the shutter plate in cooperation with the first recess, a left end wall connecting left ends of the upper and lower walls to each other, a right end wall connecting right ends of the upper and lower walls to each other, the wind guide sleeve mounted on the lower wall and adapted to be opened and closed by a vertical movement of the shutter plate, a guide groove provided on one of the housing and the shutter plate, and a guide claw provided on the other of the housing and the shutter plate, the guide groove and the guide claw being vertically slidably engaged with each other.

With the above construction, the housing can be formed of a single piece, and the mounting of the shutter plate can be easily performed, leading to a reduced number of parts and to a facilitated assembling of the parts. This largely contributes to a reduction in cost of producing the shutter means.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of a preferred embodiment in connection with the accompanying drawings.

Figure 1:
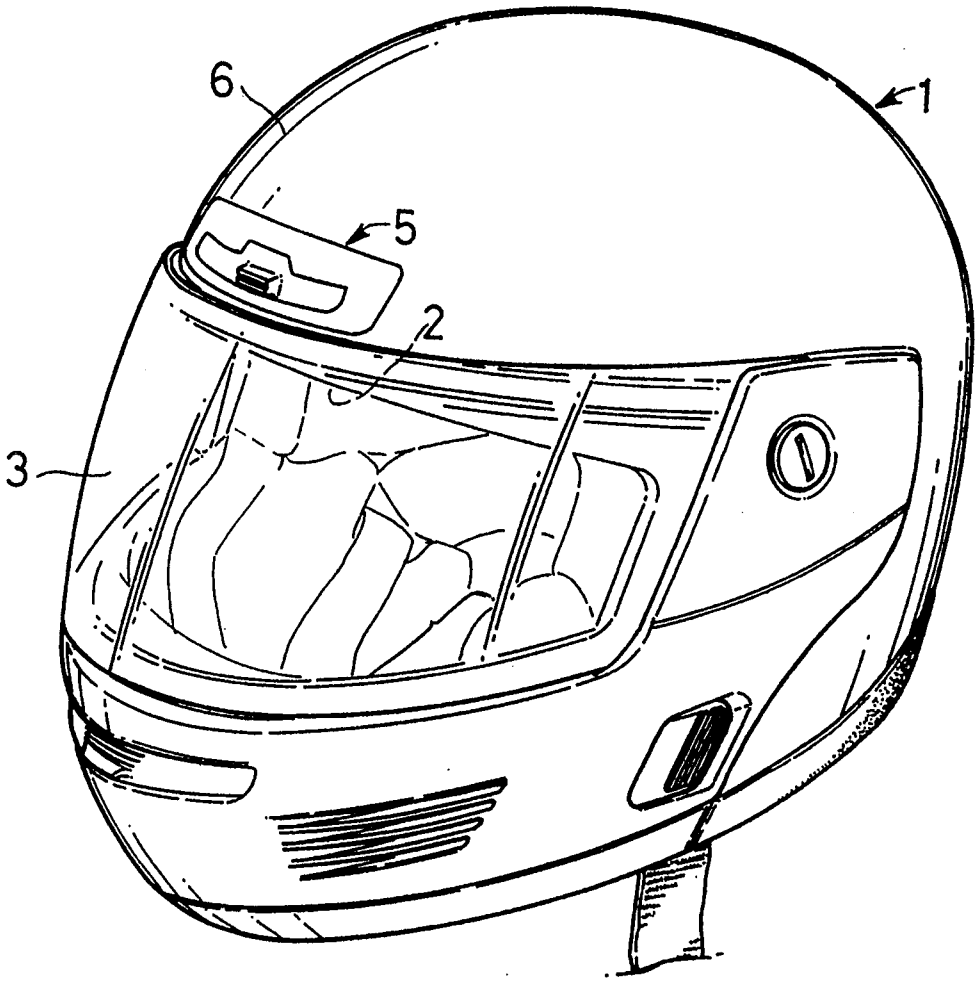
FIG.1 is a perspective view of a helmet including an air intake device according to a preferred embodiment of the present invention.
Figure 2:
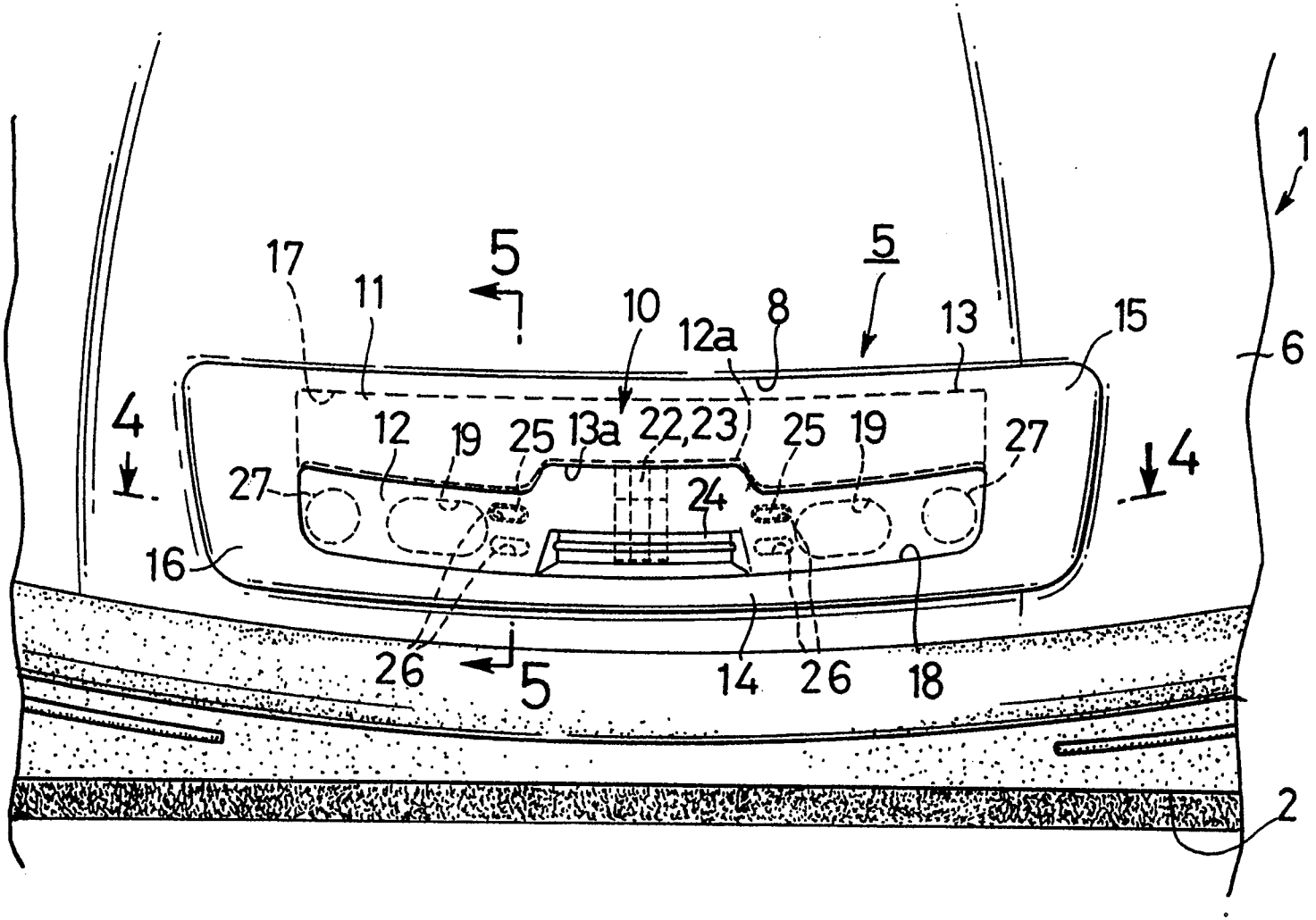
FIG.2 is a front view of the air intake device with a shutter closed.
Figure 3:
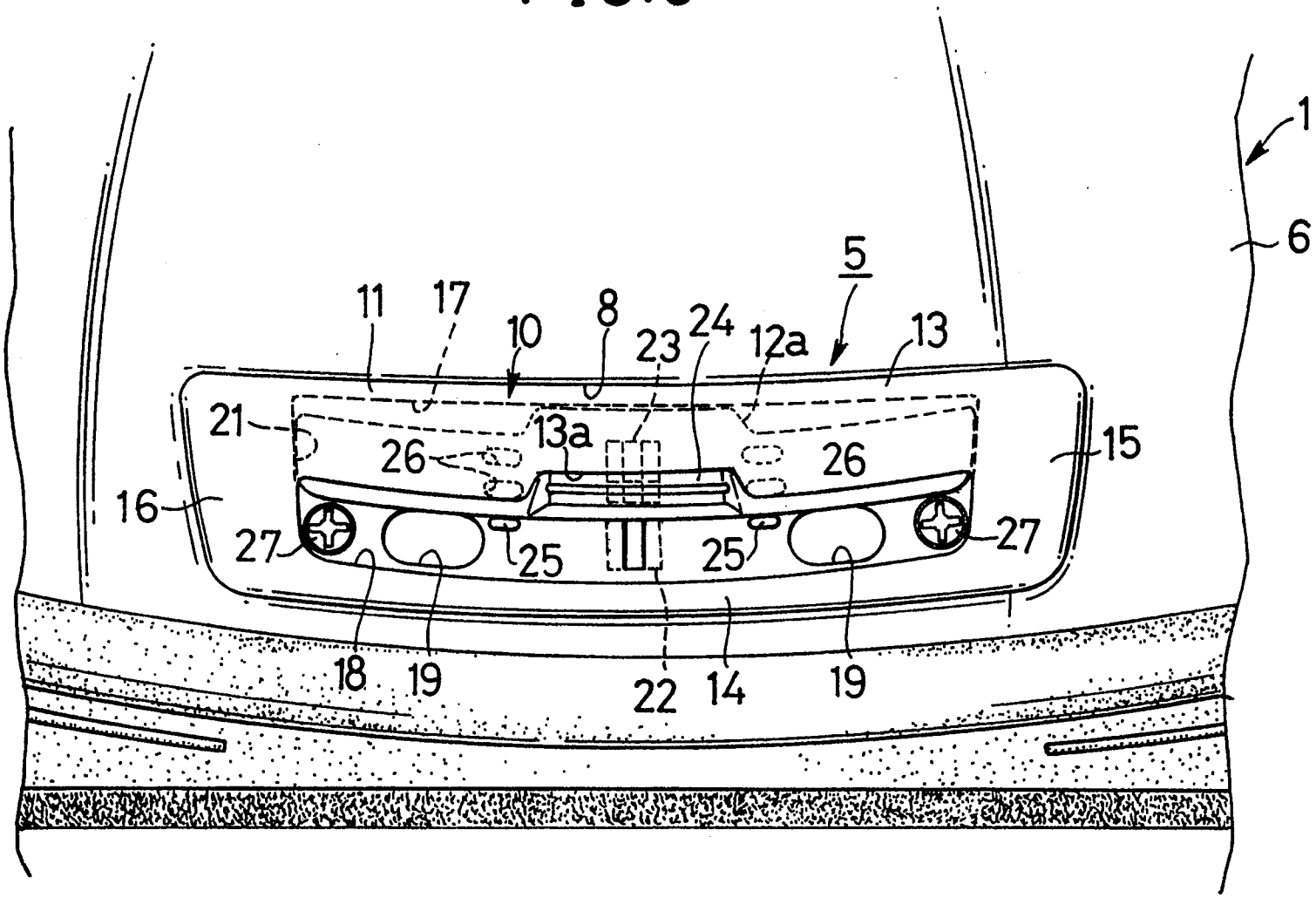
FIG.3 is a front view of the air intake device with the shutter opened.

Referring first to FIG. 1, a cap body 1 of a helmet is constructed into a full face type having a chin covering portion la provided immediately below a window 2 opened at a front surface of the body, and includes a shield plate 3 for opening and closing the window 2. For the purpose of ventilating the inside of the cap body 1, an air intake device 5 according to this embodiment is provided immediately above the window 2.

The air intake device 5 will be described with reference to FIGS.2 to 7. As shown in FIG.6, a shallow recess 8 is defined in an outer surface of a shell 6 of the cap body 1 at a location immediately above the window 2, and a shutter means 10 as an essential part of the air intake device 5 is disposed in the recess 8. A pair of air intake holes 9 and 9 are perforated in the shell 6 at the recess 8, which are connected to air ducts 30 and 30 (see FIG.4) defined in the cap body 1. Each of the air intake holes 9 is of a laterally elongated elliptic shape.

Figure 6:
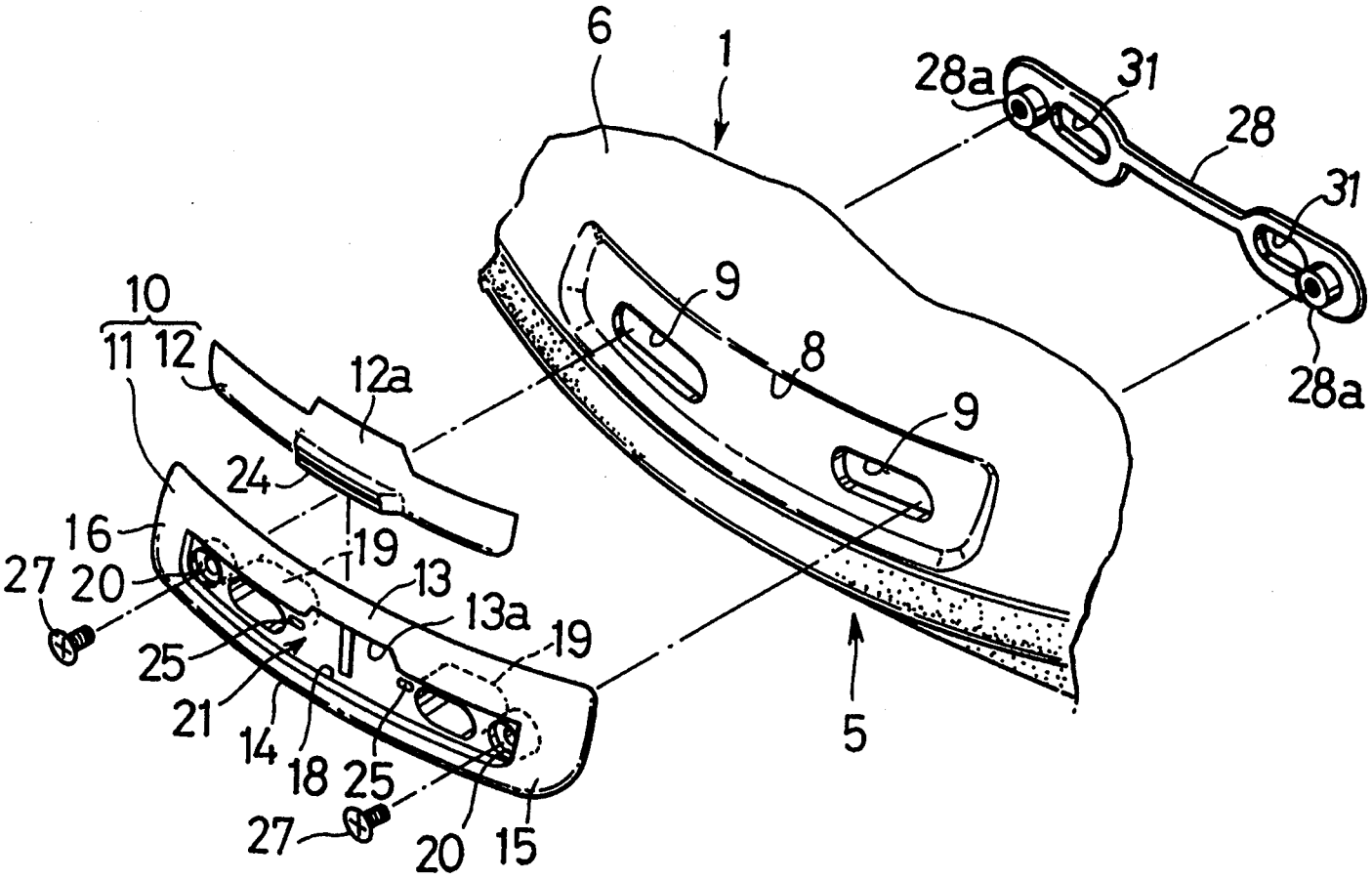
FIG.6 is an exploded forward perspective view of the air intake device.
Figure 7:
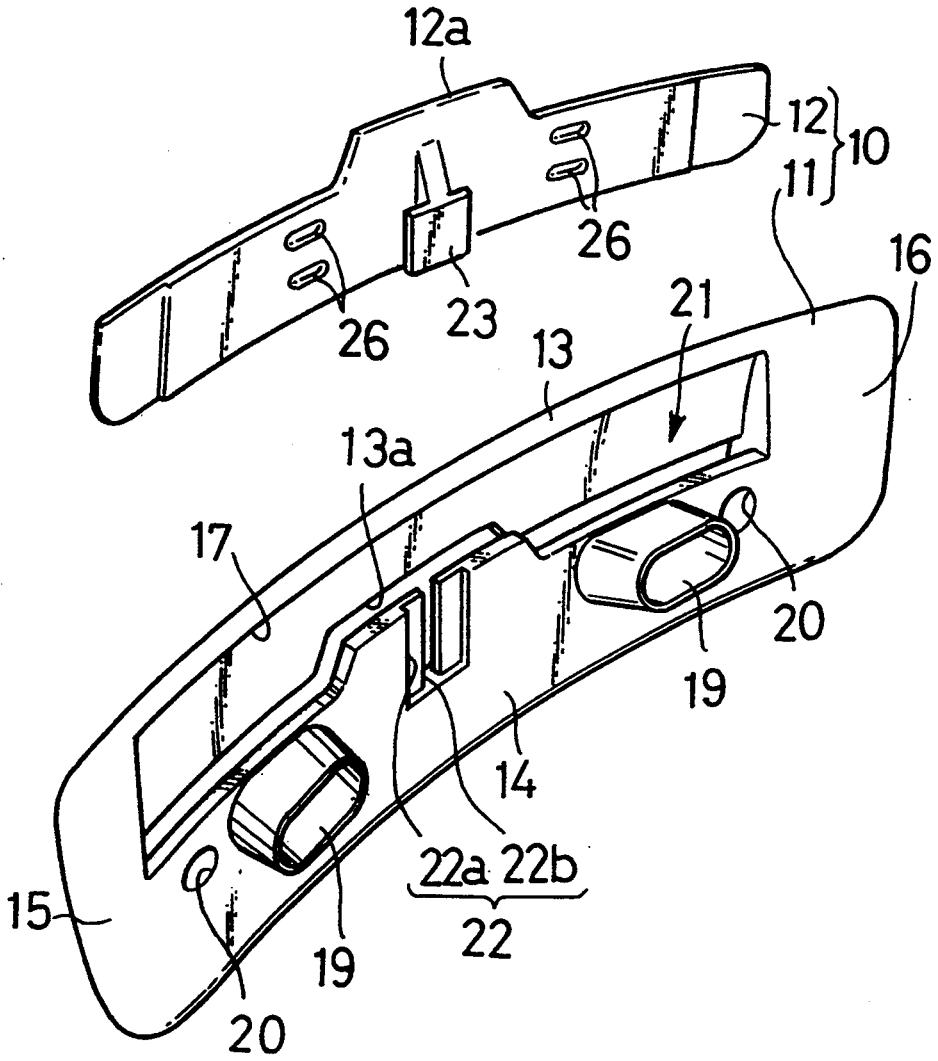
FIG.7 Ks an exploded rearward perspective view of the air intake device.

As shown in FIGS.6 and 7, the shutter means 10 is comprised of a housing 11 and a shutter plate 12 accommodated in the housing 11.

The housing 11 is monolithically or as one piece formed from a synthetic resin material and comprises an upper wall 13 having a first recess 17 provided in a back surface thereof, a lower wall 14 having a second recess 18 provided in a front surface thereof, a left end wall 15 connecting left ends of the walls 13 and 14 to each other, and a right end wall 16 connecting right ends of the walls 13 and 14 to each other. A pair of left and right wind guide sleeves 19, 19 are projectingly mounted on a back surface of the lower wall 14 so as to extend into the air intake holes 9, 9, respectively, in an assembled state and a pair of left and right mounting holes 20, 20 are provided adjacent outer sides of the wind guide sleeves 19, 19.

Figure 5:
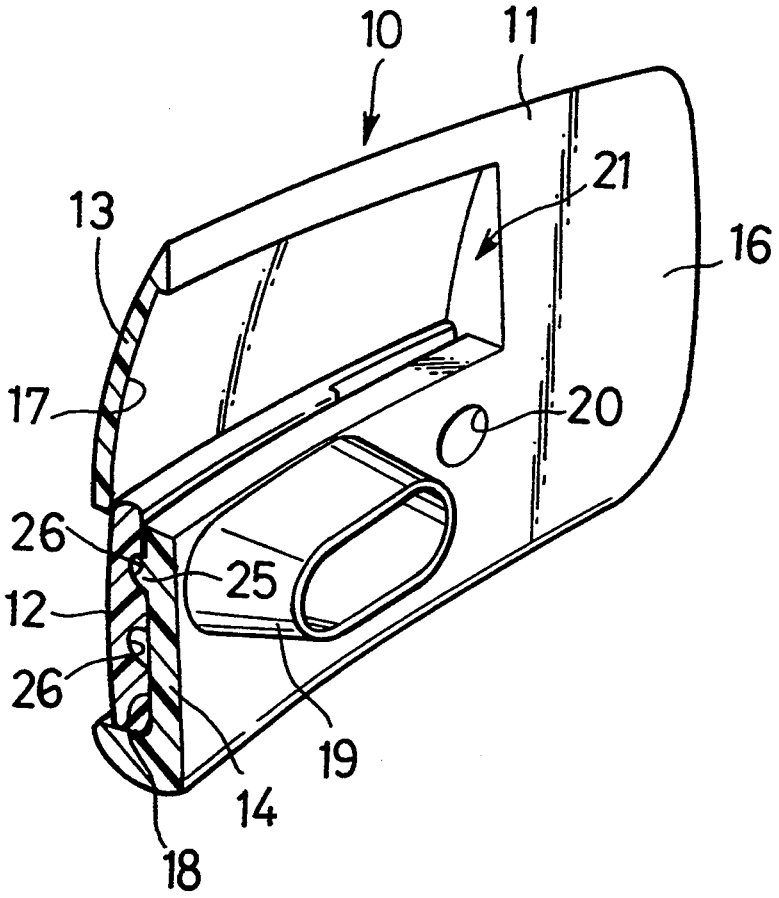
FIG.5 is a perspective sectional view taken along a line 5—5 in FIG.2.

As shown in FIG.5, the first and second recesses 17 and 18 communicate with each other and form a shutter cheer 21. The shutter plate 12 is liftably or vertically movably mounted in the shutter cheer 21 for opening and closing front opened ends of the wind guide sleeves 19, 19.

As shown in FIG.7, a guide groove 22 is provided in a laterally central portion of the lower wall 14 to extend vertically from an upper end of the lower wall 14 and is comprised of a wide groove portion 22*a* defined in the back surface of the wall 14, and a slit 22*b* running through a central portion of a bottom surface of the wide groove portion 22*a*.

On the other hand, the shutter plate 12 is also made of a synthetic resin material. A guide claw 23 having a T-shaped section is projectingly provided on a back surface of the shutter plate 12 for slide engagement with the guide groove 22, and a knob 24 is projectingly provided at a lateral central portion of a front surface of the shutter plate 12.

The shutter plate 12 is adapted to open and close the front opened ends of the wind guide sleeves 19, 19 through vertical displacements thereof. A notch 13*a* is provided in a lower edge of the upper wall 13 for receiving the knob 24, when the shutter plate 12 is in a lifted position, and a projecting piece 12*a* is connected to or integrally formed at an upper edge of the shutter plate 12 for closing the notch 13*a*, when the shutter plate 12 is in a lowered position.

As shown in FIGS.5 to 7, a pair of left and right small projections 25, 25 are formed on a bottom surface of the second recess 18, and two sets of notches 26, 26 are provided in a vertical two-stage fashion in each set on the back surface of the shutter plate 12, so that each small projection 25 is selectively brought into engagement with one of the notches 26, 26 of associated set by the resilient force given to the shutter plate 12 in response to the lifting and lowering of the shutter plate 12. More specifically, the small projections 25 can be brought into engagement with the upper notches 26 in the lowered position of the shutter plate 12; with the lower notches 26 in a position of the shutter plate 12 intermediate between its upper and lower positions; and with a lower edge of the shutter plate 12 in the lifted position of the shutter plate 12, thus retaining the shutter plate 12 at individual positions.

Figure 4:
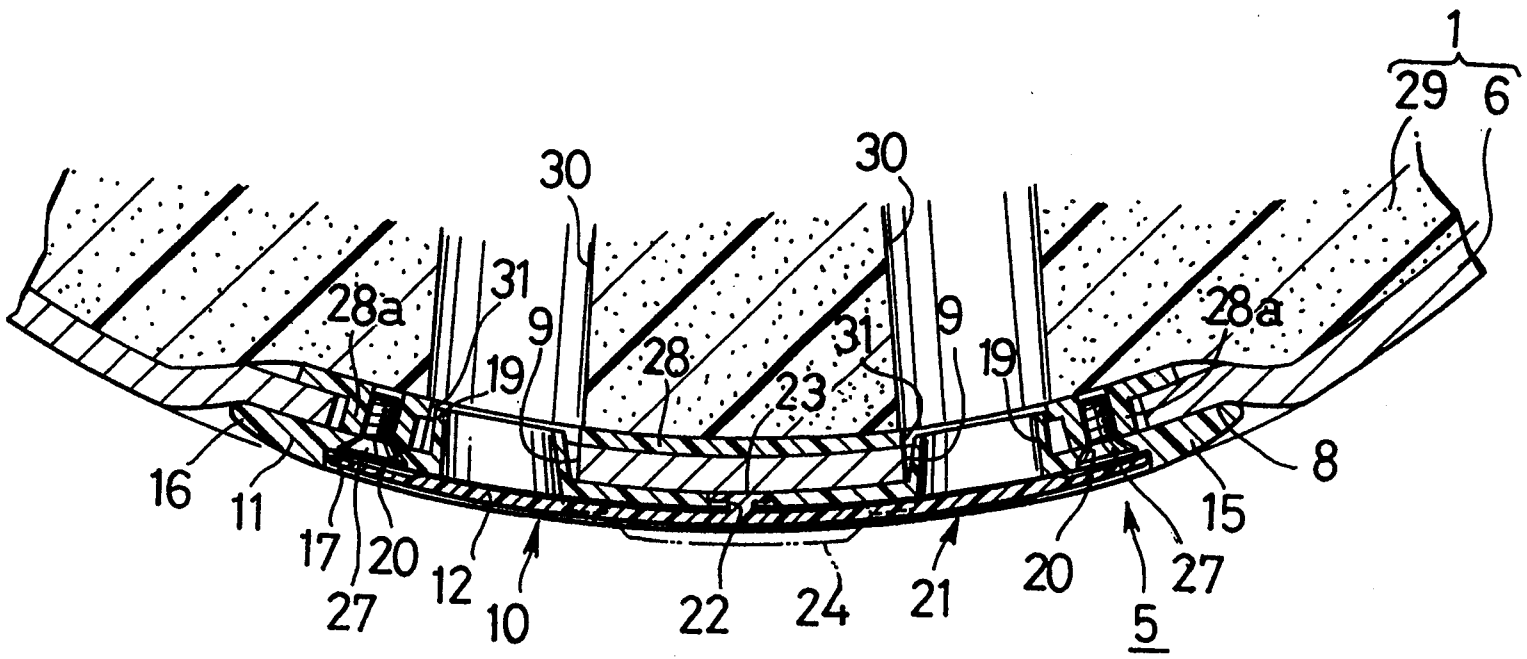
FIG.4 is a sectional view taken along a line 4—4 in FIG.2.

As shown in FIGS.4 and 6, a mounting plate 28 for mounting of the shutter means 10 is interposed between the shell 6 and a buffer liner 29 which together form the cap body 1. The mounting plate 28 includes a pair of left and right bosses 28*a*, 28*a* which are to protrude into the air intake holes 9, 9, respectively, upon assembly. The housing 11 is detachably mounted in the recess 8 in the cap body 1 by means of machine screws 27, 27 inserted through the mounting holes 20, 20 of the housing 11 and threadedly engaged into the bosses 28*a*, 28*a*, respectively. Through holes 31, 31 are provided in the mounting plate 28 so as to permit the communication between the wind guide sleeves 19, 19 and the air ducts 30, 30.

The operation of this embodiment will be described below.

In assembling process of the shutter means 10, the shutter plate 12 is inserted from the first recess 17 into the shutter chamber 21 of the housing 11 which bringing the guide claw 23 on the shutter plate 12 into engagement with the guide groove 22 in the housing 11. In this process, the knob 24 is exposed to the outside of the notch 13*a* while flexing the upper wall 13 forwardly.

In this manner, in the shutter means 10, the mounting of the shutter plate 12 to the housing 11 can be easily performed, notwithstanding that the housing 11 has been molded monolithically as one piece.

The thus-assembled shutter means 10 is positioned in the recess 8 in the front surface of the cap body 1 and is connected to the mounting plate 28 by the machine screws 27, 27 and thus secured to the cap body 1.

The shutter means 10 is detachably mounted to the cap body 1 in this manner and hence, can be removed from the cap body 1 at any time for washing with water.

In using the helmet, if the knob 24 is manipulated and displaced vertically, the shutter plate 12 is moved vertically between the first and second recesses 17 and 18, while causing the guide claw 23 and the guide groove 22 to slide relative to each other, thereby opening and closing the wind guide sleeves 19, 19. In the lifted position (see FIG.3) of the shutter plate 12, the wind guide sleeves 19 are opened, so that the open air is introduced through the wind guide sleeves 19 into the air ducts 30 in the cap body 1 to ventilate the inside of the cap body 1. In the lowered position (see FIG.2) of the shutter plate 12, the wind guide sleeves 19 are closed, so that the introduction of the open air into the air ducts 30 can be blocked.

Although the present invention has been described in connection with the preferred embodiment, it will be understood that the present invention is not limited thereto, and various modifications and variations in design can be made without departing from the spirit and scope of the invention defined in claims. For example, the guide groove 22 may be provided in the shutter plate 12, and the guide claw 23 may be provided on the housing 11. The cap body 1 may be constructed into a jet type.

What is claimed is

1. A helmet having a cap body and an air intake device the air intake device comprising a shutter means mounted to a front surface of the cap body, the shutter means including a housing having a wind guide sleeve for permitting an open air to be introduced into an air duct in the cap body, and a shutter plate vertically movably accommodated in the housing for opening and closing the air duct, wherein said housing is molded as one piece from a synthetic resin material and is comprised of an upper wall having a first recess provided in a back surface thereof, a lower wall having, in a front surface thereof, a second recess which defines a shutter chamber for accommodating the shutter plate in cooperation with the first recess, a left end wall connecting left ends of said upper and lower walls to each other, a right end wall connecting right ends of said upper and lower walls to each other, said wind guide sleeve mounted on the lower wall and adapted to be opened and closed by a vertical movement of said shutter plate, a guide groove provided on one of said housing and said shutter plate, and a guide claw provided on the other of the housing and the shutter plate, said guide groove and said guide claw being vertically slidably engaged with each other.

2. A helmet according to claim 1, wherein said wind guide sleeve is provided as a plurality of wind guide sleeves which are laterally spaced from each other.

* * * * *